United States Patent [19]

Nozawa et al.

[11] 4,141,471

[45] Feb. 27, 1979

[54] CAP FOR ATOMIZER

[75] Inventors: Takamitsu Nozawa; Nobuo Yamanaka; Riichi Ogawa, all of Tokyo, Japan

[73] Assignee: Yoshino Kogyosho Co., Ltd., Tokyo, Japan

[21] Appl. No.: 780,678

[22] Filed: Mar. 23, 1977

[30] Foreign Application Priority Data

| | | | |
|---|---|---|---|
| Apr. 6, 1976 | [JP] | Japan | 51-43017[U] |
| Apr. 8, 1976 | [JP] | Japan | 51-43702[U] |
| Apr. 16, 1976 | [JP] | Japan | 51-48232[U] |
| Apr. 16, 1976 | [JP] | Japan | 51-48233[U] |

[51] Int. Cl.[2] ..... B67D 5/06

[52] U.S. Cl. ..... 222/182; 222/402.13

[58] Field of Search ..... 222/509, 182, 402.13, 222/402.15

[56] References Cited

U.S. PATENT DOCUMENTS

| | | | |
|---|---|---|---|
| 3,180,531 | 4/1965 | Beard, Jr. et al. | 222/402.13 |
| 3,281,021 | 10/1966 | Seaquist | 222/182 |
| 3,958,726 | 5/1976 | Trotta | 222/182 |

*Primary Examiner*—Allen N. Knowles

[57] ABSTRACT

The present invention relates to a cap for an atomizer and, more particularly, to a cap for an atomizer especially of a type having a manually operated accumulation type main body.

However, the cap of the invention is widely applicable to other types of atomizers than the above mentioned type, having an ejecting pipe extending upwardly from the top surface of the main body and provided at its upper end with an atomizing head having nozzle ports (This head may be called an "actuator," as well.), the ejecting pipe being adapted to be depressed for allowing the content of the pipe to be released through the pipe to be atomized by the atomizing head.

The cap of the invention can be effectively used especially for those atomizers having a large amount of spray at one time.

The cap of the invention is characterized by comprising a lever fitted thereto for depressing the atomizing head. Thanks to the provision of this lever, the atomizing head can be depressed with a reduced force, without substantial difficulty.

6 Claims, 12 Drawing Figures

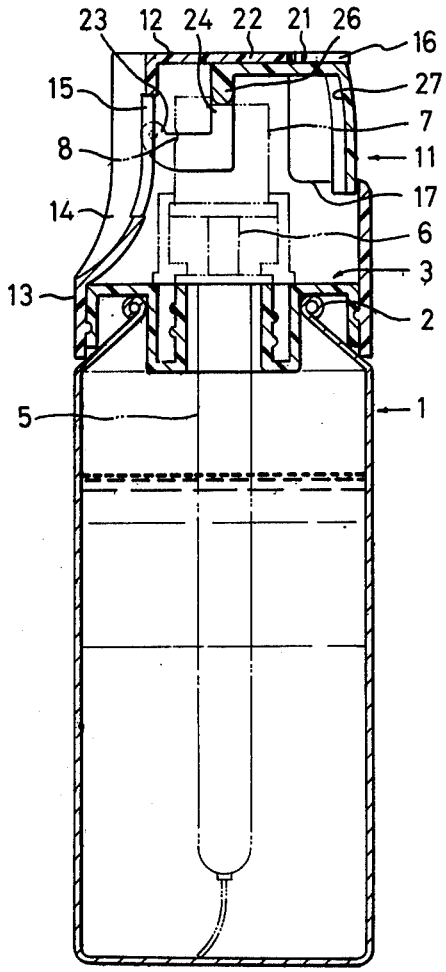
FIG. 1
FIG. 2
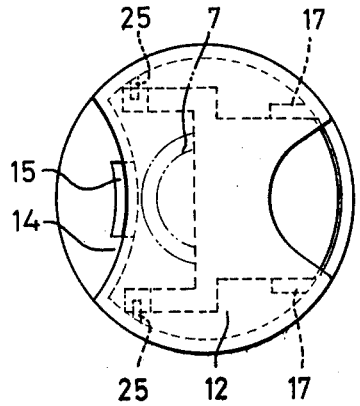

FIG. 3
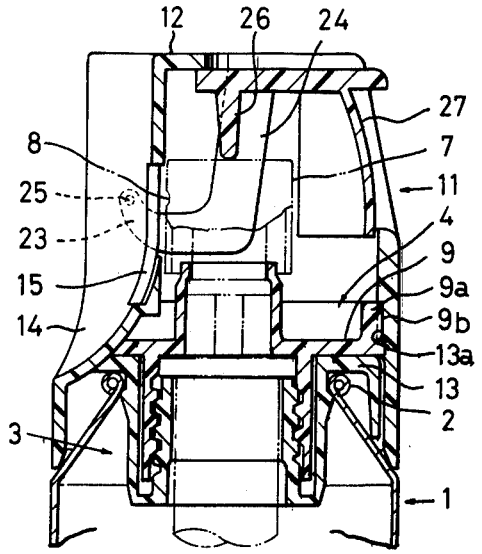
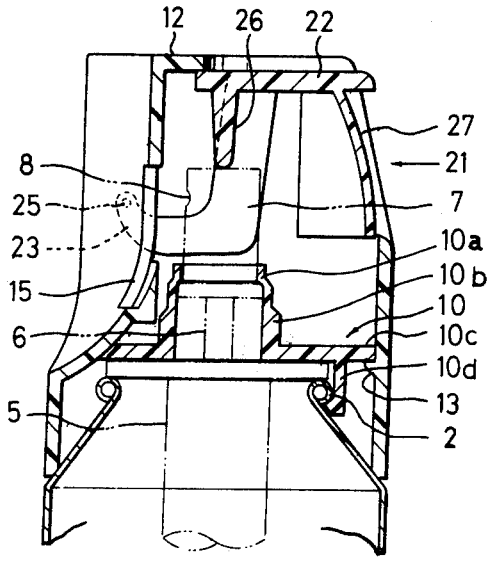
FIG. 4

FIG. 5
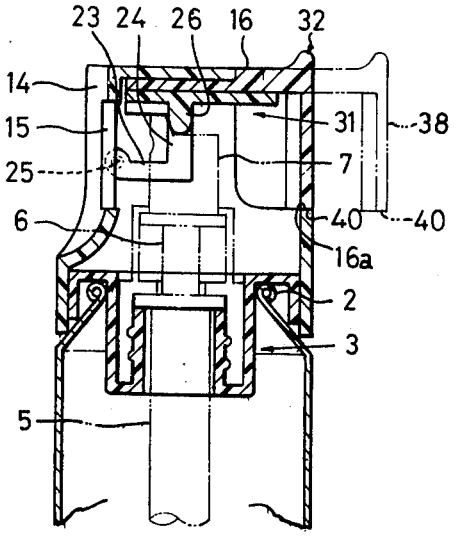
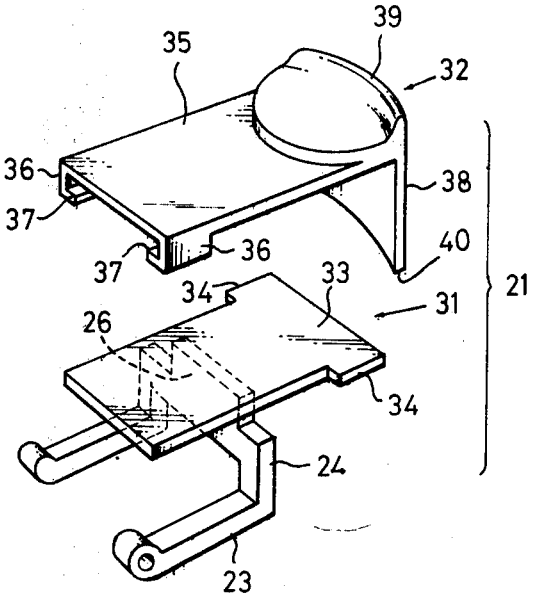
FIG. 6

FIG. 9
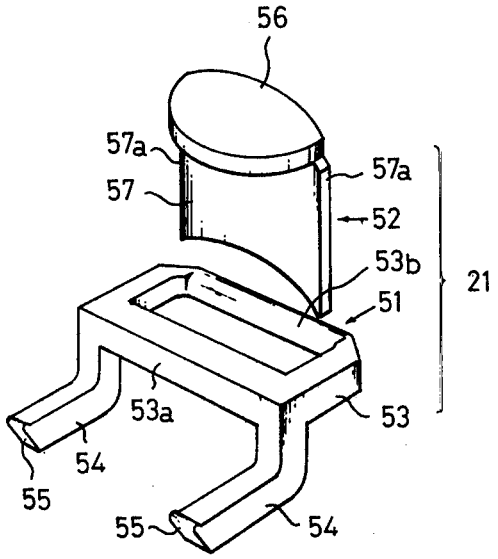
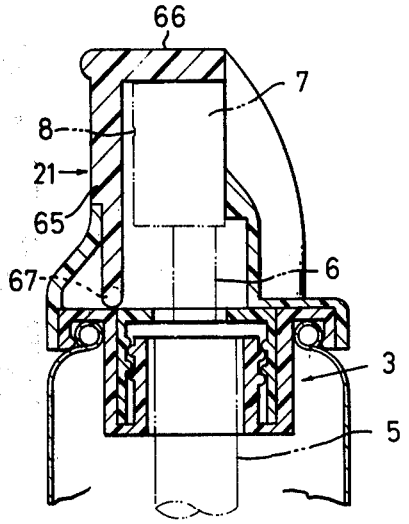
FIG. 10

CAP FOR ATOMIZER

BACKGROUND OF THE INVENTION

Conventionally, so-called air-sol type atomizer has been widely used, in which a pressurized propellant gas is used. The gas has been found, however, harmful to human bodies. In addition, there is a danger that the wasted container may explode due to the residual propellant gas.

For these reasons, so-called manual type small sized atomizers are now under reconsideration.

However, in conventional atomizers of this type, it is difficult to obtain a sufficient atomizing pressure, especially at the beginning of the atomization, so that fine particles of atomized content are not available.

In order to overcome this problem, the present Applicant has proposed a so-called accumulator type atomizer, in U.S. Pat. No. 3,908,870. This type of atomizer has a discharge valve which is forced to be closed, even when a atomizing head is depressed, until a sufficient pressure is established within the cylinder chamber. In other words, the discharge valve is allowed to open only after a sufficient pressure has been established to allow the atomization.

Although this accumulator type atomizer provides a solution to the aforementioned problem, another problem is caused that a considerably large force is required for depressing the atomizer head, resisting the forcible closing force on the discharge valve.

Also, in the atomizer of the other type than the accumulator type, a large depressing force is required for depressing the atomizer head, when the amount of spray at one time is large.

The present invention is aiming at providing a cap which is most advantageously used for these atomizers which require a large depressing force on the atomizer head, especially for accumulator type ones.

SUMMARY OF THE INVENTION

The present invention is aimed at reducing the force required for depressing the atomizer head by a provision of a handle lever to a cap of the atomizer, and provides the greatest advantage when used in combination with an accumulator type atomizer or other type of atomizer in which the amount of spray at one time is relatively large.

Thus, it is one object of the invention to make it possible to depress the atomizer head for atomization with a reduced force.

It is another object of the invention to prevent the atomized content which may be a chemical substance from attaching to the skin of hands, by allowing the operation at a position remote from the nozzle, thereby to protect the hands from bad effect on one's health.

It is still another object of the invention to prevent dusts or other contaminants from sticking to the atomizing head, by disposing the head within a cap, and, at the same time, to make it possible to operate the atomizer with the cap fitted onto the atomizing head, i.e. without necessitating the removal of the cap.

It is a further object of the invention to provide an atomizer having a handle lever, in which the handle lever does never hinder the packing of the atomizer for transportation.

These and other objects, as well as advantageous features and effects of the invention will become clear from the following description of preferred embodiments taken in conjunction with the attached drawings in which:

BRIEF EXPLANATION OF THE DRAWINGS

FIG. 1 is a vertical sectional view of an atomizer having a cap embodying the present invention fitted thereon.

FIG. 2 is a plan view of the atomizer of FIG. 1,

FIG. 3 is a vertical sectional view of a cap of another embodiment of the invention, FIG. 4 is a vertical sectional view of still another embodiment of the present invention, FIG. 5 is a vertical sectional view of a further embodiment of the present invention, FIG. 6 is an exploded perspective view of a member for use in the cap of FIG. 5, FIG. 9 is an exploded perspective view of a member for use in the cap of FIG. 7, FIG. 10 is a vertical sectional view of a still further embodiment of the present invention.

DESCRIPTION OF PREFERRED EMBODIMENTS

Figure 7:
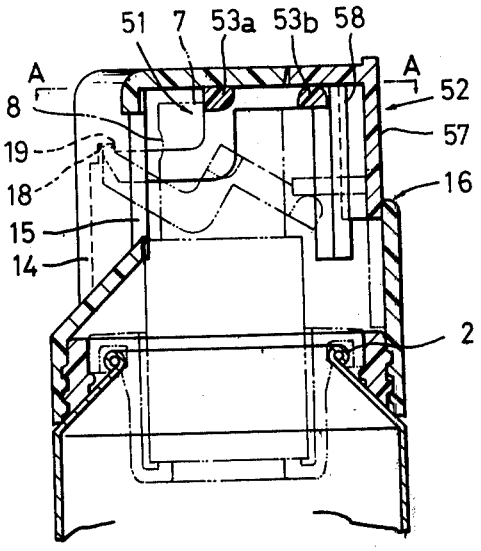
FIG. 7 is a vertical sectional view of a still further embodiment of the present invention.
Figure 8:
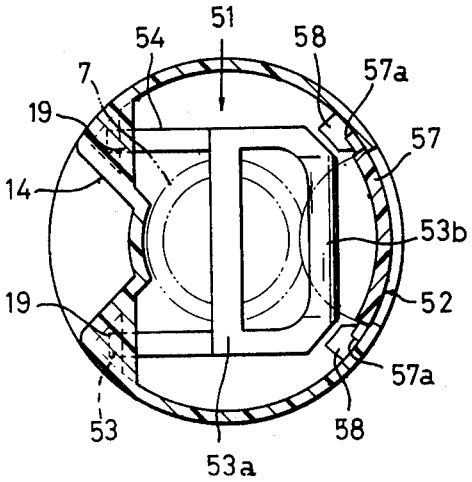
FIG. 8 is a sectional view taken along the line A—A of FIG. 7.

Referring at first to FIGS. 1 and 2 showing a preferred embodiment of the present invention, a main container body 1 containing a liquid to be atomized has an opening or outlet 2 to which fitted is a plug 3. An atomizer assembly consisting of a cylinder 5, a communication pipe 6 and an atomizer head 7 is attached to the container body 1 by means of the plug 3 and a retainer sleeve 4 screwed into the plug 3.

The arrangement is such that the liquid having been sucked into the cylinder is atomized from nozzle ports 8 formed in the peripheral wall of the atomizer head, through the communication pipe, as the atomizer head is depressed, while the atomizer head is moved back upwardly by a spring, as it is released, to cause a vacuum within the cylinder to suck the liquid for next atomization by the subsequent depressing of the atomizer head.

A cap 11 in accordance with the invention has a top wall 12 and a vertical peripheral wall 13 extending downwardly from the peripheral edge of the top wall 12. The cap 11 is adapted to be fitted onto the plug 3 on the container body 1, at its vertical peripheral wall 13.

As will be seen from the drawings, the peripheral wall 13 is provided at its front portion with an inwardly curved recess 14 the inner wall of which is made to approach the nozzle port 8 and is opened at a portion in front of the nozzle port 8 to provide a window 15 for the atomization.

The window 15 is elongated in the direction of the cylinder to allow the atomized liquid to be spread outwardly therethrough.

Another opening or window 16 for operation is provided over the top wall 12 and the rear upper portion of the peripheral vertical wall connected to that portion.

Second shielding plates 17,17 are optionally provided to shield the interior of the cap when a later-mentioned handle lever is depressed. For this purpose, the plates 17,17 are suspended from the back surface of the top wall.

The handle lever 21 has supporting rods 23,24 projected from both sides of the front portion of a plate 22. In the illustrated embodiment, the rods are projected through vertically downwardly extending portions 24,24.

The supporting rods are pivoted at their ends to the inner surface of the cap at front portion of the latter, through pins 25,25.

The pins 25,25 may be provided on the supporting rods and received by recesses or bores in the cap, or may be vice versa.

A projection 26 may be provided for depressing the atomizer head, at the front lower edge of the plate. A shield plate 27 is suspended from the rear end of the plate 22. The arrangement is such that the top wall of the cap comes in contact with the plate when the cap is fitted, or with the lower surface of the projection 26 when it is provided.

The window 16 for operation is adapted to be closed by the rear portion of the plate and the shielding plate.

As the rear portion of the plate is depressed at this condition, the handle lever 21 is rotated around the pins 26,26, so that the atomizer head and the communication pipe 6 are depressed to allow the atomization from the nozzle port. The atomized liquid is then discharged outwardly through the window 15 for the atomized liquid.

As the plate is released from the depressing force exerted by a finger, a spring disposed with the cylinder moves the atomizer head back upwardly which returns the handle lever also up to the original position of FIG. 1.

In the embodiment of FIG. 3, the cap is modified to have the inwardly curved recessed portion 14 extending down to the lower portion of the peripheral wall.

In this embodiment, front portion of the peripheral wall of the plug 3, as well as the front portion of the sleeve 4 are notched so as not to hinder the inwardly projected wall of the recessed portion 14.

The sleeve 4 screwed to the plug has an outwardly exdtending flange 9 having a peripheral fitting wall extending upwardly from its peripheral portion excepting the front portion.

A number of engaging projections 9*b* are formed on the fitting wall for engagement with projections 13*a* . . . formed in the inner wall of the cap so as to fix the cap 11 to the sleeve 4 against a rotation.

In the embodiment of FIG. 4, the combination of the plug and the sleeve are substituted by a retainer member 10.

The retainer member 10 has a peripheral wall 10*b* having at its upper end an engaging projection 10*a* and at its lower end an outwardly extending flange 10*c*. A fitting wall 10*d* is suspended from the lower surface of the flange, excepting the front portion of the latter, for fitting around the opening of the container body. A projection formed on the outer peripheral surface of the atomizer head at the lower portion thereof is adapted for engagement with said engaging projection of the retainer member, thereby to prevent the atomizer head from being moved unintentionally.

In the embodiments of FIGS. 3 and 4, the handle lever is formed to extend rearwardly from the plate, and the shield plate 27 is suspended from the position slightly ahead of the rearmost portion of the later.

In the embodiment of FIG. 5, the handle lever 21 consists of a lever body 31 and a sliding member 32. The lever body 31 has a plate portion 33 equipped with stoppers 34,34 at both sides of the rear end of the later 33.

The sliding member 32 has a plate portion 35 and a pair of side walls 36,36 suspended from both sides of the front portion of the plate portion 35. Each side wall has an inwardly extending engaging projection 37. A shield plate 38 is suspended from the rear end of the plate portion. A finger retaining portion 39 is formed on the rear portion of the plate portion. The plate portion 35 is slidably received by the gaps formed between the side walls 36,36 and between the engaging portions 37,37.

Ends of supporting rods are pivoted to the inner peripheral wall of the cap body, as is the case of the foregoing embodiments.

The arrangement is such that the lower end surface 40 of the shield plate 38 can be mounted on the lower edge 16*a* of the window 16 for the operation, when the sliding member 32 is brought to its most forward position.

In operation, the depression is made until the rear ends of the side walls 36,36 come in contact with the stoppers 34,34, as shown in two-dots-and dash line in FIG. 5.

After use, the sliding member is forced into again, so that the depression of the sliding member is prevented by the engagement of the lower edge of the shielding plate with the upper surface of the lower edge of the operation window 16.

In the embodiment of FIG. 7, the handle lever 21 is composed of a lever body 51 and an operating member 52.

The lever body 51 has a frame-like receptacle 53 having both side edges bent to form forwardly extending supporting rods 54,54. Engaging projections 55,55 are provided on the upper edges of the ends of the supporting rods.

Engaging plates 19,19 having engaging recesses 18,18 are formed at both side portions of the peripheral wall of the cap body.

The arrangement is such that the fore rod 53*a* of the receptacle is in contact with the top wall of the atomizer head 7, when the engaging projections 55,55 are in engagement with the engaging recesses 18,18 and the upper surface of the fore rod is in contact with the lower surface of the top wall of the cap body, while the rear rod 53*b* of the receptacle projects into the operation window 16.

The operation member 52 has a pressing plate 56 having a sliding wall 57 suspended from the lower edge of the rear end of the later.

The pressing plate is capable of closing the portion of the window 16 in the top wall, while the sliding plate is adapted to close the rear portion of the window.

Both the side portions 57*a*, 57*a* of the sliding wall is received by engaging portions 58,58 of the reap portion of the window, so that the sliding wall may be moved only up and downward direction.

The pressing plate is adapted to be abut by its lower surface by the upper surface of the receptacle 53.

As shown in FIG. 7, the receptacle 53 is depressed to cause a rotary member to rotate around the end of the lever, depressing the actuator, as the pressing plate is depressed with the cap assembled and fitted on the container body. As the pressing plate is released, the upwardly biased actuator is moved to cause the returning motion of the rotary member and the operation member 52 the back surface of the end portion of which being in engagement with the upper surface of the rear portion of the receptacle of the rotary member.

Referring next to the embodiment of FIG. 10, a window 61 is formed bridging over the front and rear top portions of the cap body. At the front portion of the window 61, guiding grooves 63,63 are provided to extend in the direction of the cylinder, at both side of the opening 62 of the window.

The operation lever 21 is provided with a vertical wall 65 capable of closing the front opening of the window, and has at its upper to rear portions a horizontal wall 66 capable of closing the top opening 64 of the window.

Pins 67,67 are provided at both lateral side portions of the lower section of the vertical wall 65, so as to be received by the aforementioned guiding grooves 63,63.

The arrangement is such that the operation member can be tilted rearwardly, when the pins are at their uppermost positions within the guiding grooves, i.e. when the operation member has been lifted to its uppermost position.

Figure 11:
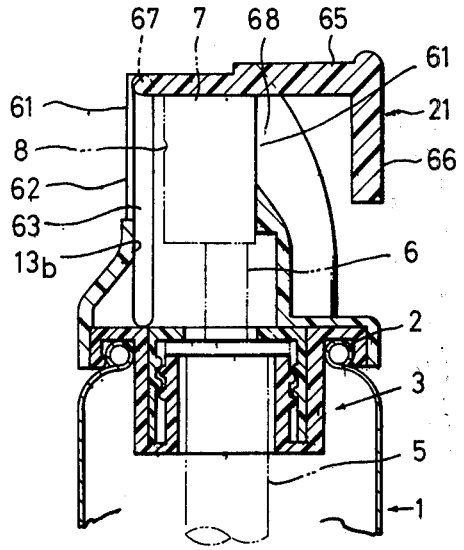
FIG. 11 is a vertical sectional view illustrating the manner of operation of the embodiment of FIG. 10.
Figure 12:
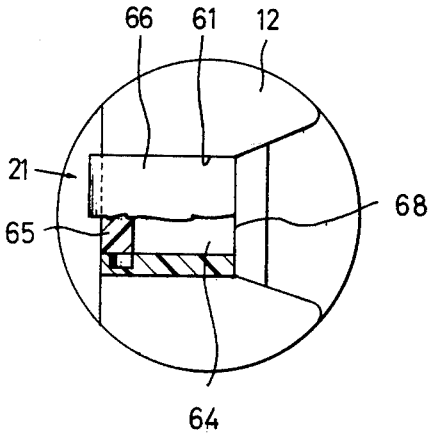
FIG. 12 is a plan view of the cap of FIG. 10.

As will be seen from FIG. 11, when the cap is fitted to the container body, the vertical wall keeps a horizontal posture maintaining a contact with the top wall of the atomizer head 7. As the horizontal wall section 66 is depressed from this state, pins 67, 67 are brought into engagement with the top ends of respective guiding grooves 63,63, so as to cause the rotation of the operation lever around the pins, resulting in a depression of the atomizer head to perform the atomization through the nozzle port 8.

By arranging such that the lower portion of the vertical wall comes inside of the lower portion of the forward peripheral wall, when the vertical wall closes the front opening 62 of the window, the forward inclination of the operating member is prevented by the abutment of the inner portion **13*b* of the lower edge of the front opening and the outer surface of mid portion of the vertical wall, as will be seen from FIG. 10**.

The backward inclination is prevented by the atomizer head.

The rear opening 68 of the window is so designed as to be closed by the rear portion of the peripheral wall of the atomizer head.

When the operation member is kept upright, front and top openings of the window are closed by the vertical and horizontal walls, respectively, so that the actuator cannot be depressed, thus playing a role of a safety device, while, for use, the operation member is lifted up and tilted backwardly to play the role of a lever for depressing the actuator with a reduced force.

What is claimed is:

1. A cap for use with an atomizer connected to a container body and operable to spray liquid through a nozzle of the atomizer upon movement of an atomizer head, said cap comprising:

a cylindrical cap body including a top wall and a peripheral wall having a lower portion adapted to be fitted onto a container body of an atomizer; and an operation lever provided internally of said cap body, said cap body including an elongated atomizing window, said window extending parallel to the axis of said cap body, in a front portion of said peripheral wall, said cap body further including an operation window in at least a rear upper portion of said peripheral wall and a portion of said top wall adjacent said rear upper portion, said operation lever including:

one end engaging a front inner surface of said peripheral wall of said cap body;

a front lower surface adapted to engage a top surface of an atomizer head resiliently projecting from a container body;

a rear end dispsed in said operation window; and a shielding plate sealing at least the portion of said operation window in the upper rear portion of said peripheral wall, whereby the atomizer head is depressed as said operation lever is depressed.

2. A cap as claimed in claim 1, wherein said peripheral wall of said cap body is curved inwardly adjacent said atomizing window.

3. A cap as claimed in claim 1, wherein said operation lever includes a plate portion and supporting rods extending from both sides of a front portion of the plate portion, said supporting rods being pivoted to the inner surface of the peripheral wall of said cap body, a front upper portion of said operation lever normally engaging said top wall, and wherein said operation window is covered by said plate portion and by said shielding plate, said sealing portion being suspended from said plate portion.

4. A cap as claimed in claim 1, wherein said operation lever includes an attaching member and a sliding member, said attaching member including a plate portion and a pair of supporting rods extending forwardly from two front sides of the plate portion, said supporting rods being pivoted at their ends to the inner surface of said cap body, said sliding member including said shielding plate and being movable between two positions with respect to said plate portion, such that a lower rear surface of said sliding member engages the lower edge of said operating window, with said sliding member covering said operating window when said sliding member is in a first of said position, and said sliding member is movable downwardly when in a second of said positions.

5. A cap as claimed in claim 1, wherein said operation lever includes: a receptacle portion positioned adjacent the back side of the top wall of said cap body; a rotary member consisting of levers extending from both sides of said receptacle portion and retained at their ends by the inner wall of said cap body at respective sides of said atomizing window; and a pressing plate capable of closing the top opening of said operation window formed in said top wall of said cap body, said pressing plate being to engage the upper surface of said receptacle portion, said shielding plate forming a slidable wall portion capable of closing the rear opening of said operation window and being suspended from the rear edge of said pressing plate, said sliding wall portion being slidably received by engaging members formed at both sides of said rear opening.

6. A cap for use with an atomizer connected to a container body and operable to spray liquid through a nozzle of the atomizer upon movement of an atomizer head, said cap comprising:

a cylindrical cap body including a top wall and a peripheral wall having a lower portion adapted to be fitted onto a container body of an atomizer; and an operation lever provided internally of said cap body, said cap body including an elongated atomizing window, said window extending parallel to the axis of said cap body, in a front portion of said peripheral wall, said cap body further including an operation window in at least a rear upper portion of said peripheral wall and a portion of said top wall adjacent said rear upper portion, said cap body having an opening formed in its top wall connecting said atomizing and operation windows to form a single window, said cap body further including guiding grooves extending along both sides of the front opening of said single window, said operation lever including:

one end engaging a front inner surface of said peripheral wall of said cap body;

a front lower surface adapted to engage a top surface of an atomizer head resiliently projecting from a container body;

a rear end disposed in said operation window;

a vertical wall portion capable of closing said front opening of said window; and pins extending outwardly from respective side edges of said vertical wall, said pins being received by said guiding grooves for free up and down movement therealong, said operation lever further having a horizontal wall portion adapted to extend over the top wall of said atomizer head when said pins are at their lowermost positions in said guiding grooves, whereby the front lower surface of said vertical wall portion engages said top wall of said atomizer head when said operation lever is tilted rearwardly with said pins located at their uppermost positions so that the atomizer head may be depressed by movement of said operation lever.

* * * * *